US006024627A

United States Patent [19]

Tilbor et al.

[11] Patent Number: 6,024,627

[45] Date of Patent: Feb. 15, 2000

[54] TOY VEHICLE WITH GYROSCOPIC ACTION REAR WHEELS

[76] Inventors: Neil Tilbor, 4707 Van Kleeck Dr.; Michael G. Hetman, 6274 Engram Rd., both of New Smyrna Beach, Fla. 32169

[21] Appl. No.: 08/914,621

[22] Filed: Aug. 19, 1997

[51] Int. Cl.[7] ..... A63H 30/04; A63H 17/36; A63H 17/00; A63H 17/26

[52] U.S. Cl. ..... 446/456; 446/460; 446/465; 446/470; 446/233

[58] Field of Search ..... 446/454, 455, 446/456, 457, 460, 462, 465, 470, 471, 233

[56] References Cited

U.S. PATENT DOCUMENTS

| | | | |
|---|---|---|---|
| Re. 30,299 | 6/1980 | Greenwood . | |
| 2,175,845 | 10/1939 | Lohr . | |
| 2,247,354 | 7/1941 | Berger . | |
| 2,829,467 | 4/1958 | Pagano . | |
| 3,650,067 | 3/1972 | Greenwood . | |
| 3,702,037 | 11/1972 | Toy et al. . | |
| 3,708,913 | 1/1973 | Terzian et al. . | |
| 3,756,338 | 9/1973 | Goodridge . | |
| 3,772,824 | 11/1973 | Terzian et al. . | |
| 3,785,085 | 1/1974 | Peroni | 446/437 X |
| 3,886,682 | 6/1975 | Ieda et al. . | |
| 3,952,786 | 4/1976 | Kreling et al. | 446/465 X |
| 4,156,986 | 6/1979 | Kupperman et al. | 446/462 |
| 4,183,174 | 1/1980 | Barris et al. | 446/462 X |
| 4,201,011 | 5/1980 | Cook . | |
| 4,267,663 | 5/1981 | Nagahara . | |
| 4,290,228 | 9/1981 | Goldfarb et al. . | |
| 4,300,308 | 11/1981 | Ikeda . | |
| 4,309,841 | 1/1982 | Asano . | |
| 4,329,810 | 5/1982 | Terui . | |
| 4,363,186 | 12/1982 | Goldfarb et al. . | |
| 4,363,187 | 12/1982 | Shinohara . | |
| 4,383,388 | 5/1983 | Suimon . | |
| 4,387,532 | 6/1983 | Suimon . | |
| 4,438,589 | 3/1984 | Matsushiro . | |
| 4,449,323 | 5/1984 | Fisher . | |
| 4,457,101 | 7/1984 | Matsushiro . | |
| 4,477,999 | 10/1984 | Harigai et al. . | |

(List continued on next page.)

FOREIGN PATENT DOCUMENTS

| | | | |
|---|---|---|---|
| 663278 | 4/1964 | Italy | 446/233 |
| 56-13971 | 2/1981 | Japan . | |
| 62-107891 | 7/1987 | Japan . | |
| 1557404 | 12/1979 | United Kingdom | 446/462 |

*Primary Examiner*—D Neal Muir
*Attorney, Agent, or Firm*—Akin, Gump, Strauss, Hauer & Feld, L.L.P.

[57] ABSTRACT

A remotely controlled toy vehicle includes a pair of parallel front wheels a pair of rear wheels at least essentially unchanging in configuration and outer diameter during operation, and a pair of reversible electric motors controlled remotely from the vehicle, each motor driving a separate one of the pair of rear wheels independently of the other motor and other rear wheel to selectively propel and steer the toy vehicle during operation. Each rear wheel has a maximum outer diameter (D) that is: greater than a minimum distance (T) between facing sides of the pair of rear wheels; more than twice the diameter (d) of each front wheel; greater than the distance (WB) between the front and rear wheel axes; and/or more than one-half the overall vehicle length (L) along its centerline. At least two-thirds and suggestedly at least three-quarters of the weight of each rear wheel is located within fifteen percent of an outer end of the rear wheel radius adjoining an outer circumference of each rear wheel. The combined weights of the two rear wheels is at least thirty percent of the total weight of the vehicle and, where the vehicle includes a battery power supply to operate the motors, the combined weight of the two wheels is preferably at least thirty percent of the total weight of the vehicle without such batteries.

11 Claims, 4 Drawing Sheets

U.S. PATENT DOCUMENTS 4,480,401 11/1984 Matsushiro .
4,493,672 1/1985 Terui .
4,505,346 3/1985 Mueller ..... 446/462 X
4,508,516 4/1985 D'Andrade et al. .
4,526,554 7/1985 Goldfarb et al. .
4,568,306 2/1986 Martin .
4,568,309 2/1986 Maxim et al. .
4,580,994 4/1986 Fauser et al. .
4,597,744 7/1986 Rehkemper et al. .
4,601,674 7/1986 Koizumi .
4,680,021 7/1987 Maxim .
4,712,806 12/1987 Patrin .
4,715,602 12/1987 May et al. .
4,850,931 7/1989 Auer .
4,902,271 2/1990 Yoneda .
4,966,569 10/1990 Asano .
5,135,427 8/1992 Suto et al. .
5,173,073 12/1992 Franzone .
5,334,078 8/1994 Hippely et al. .
5,368,516 11/1994 Hoeting et al. .
5,429,543 7/1995 Tilbor et al. .
5,487,692 1/1996 Mowrer et al. .
5,643,036 7/1997 Liu et al. .
5,667,420 9/1997 Menow et al. .
5,667,421 9/1997 Uetake .
5,709,583 1/1998 Suto et al. .
5,727,985 3/1998 George et al. ..... 446/470 X

TOY VEHICLE WITH GYROSCOPIC ACTION REAR WHEELS

BACKGROUND OF THE INVENTION

The present invention relates to toy vehicles and, in particular, to remotely controlled toy vehicles having unusual action capabilities.

Remotely controlled toy vehicles, particularly wireless, radio-controlled toy vehicles, have come to constitute a significant specialty toy market. Manufacturers in this market attempt to duplicate well known vehicles as well as the latest in automotive developments, including specialty entertainment vehicles. In addition, manufacturers are constantly seeking new ways and features to add innovative action to such toy vehicles to make such toy vehicles more versatile and/or more entertaining.

One well known vehicle trick is the front wheel rise or "wheelie", in which the front end of the vehicle lifts off the ground and the vehicle travels only on its rear wheel(s). Another vehicle trick is a rapid, in-place spin where the vehicle rotates in place (or essentially in place) at high speed on two wheels generally about a vertical axis extending through the vehicle.

Yet another stunt maneuver involves providing a remotely controlled toy vehicle with a body and chassis sufficiently small so as to fit within planes tangent to opposing sides of the front and rear wheels, thereby enabling the vehicle to be operated with either of its two major sides between the wheels up or down. In addition, the rear end of such vehicles may be located within the silhouettes of the two rear mount wheels of the vehicle so that the vehicle can be made to pivot over the rear wheels to reverse the major side of the vehicle which is on the upper side for operation.

It is also known to use wheels in radio-controlled motorcycles which are weighted in a way to enhance a gyroscopic effect created when the wheels are rapidly rotated in order to assist such two-wheeled vehicles to remain upright while being operated. The effect of using such wheels side by side on three or more wheeled toy vehicles are unknown.

BRIEF SUMMARY OF THE INVENTION

In one aspect, the invention is an improvement in a remotely controlled toy vehicle including a pair of parallel front wheels, a pair of rear wheels at least essentially invariant in configuration and outer diameter during operation, a pair of reversible motors controlled remotely from the vehicle, each motor driving a separate one of the pair of rear wheels independently of the other motor to selectively propel and steer the vehicle during operation of the vehicle, centers of the front wheels lying along a common front axis and centers of the rear wheels lying along a common rear axis parallel with the front axis, the improvement wherein each rear wheel has a fixed maximum outer diameter greater than a minimum distance between facing sides of the pair of rear wheels.

In another aspect, the invention is an improvement in a remotely controlled toy vehicle including a pair of parallel front wheels and a pair of rear wheels, a pair of reversible motors controlled remotely from the vehicle, each motor driving a separate one of the pair of rear wheels independently of the other motor and rear wheel to selectively propel and steer the toy vehicle during operation of the vehicle, centers of the front wheels lying along a common front axis and centers of the rear wheels lying along a common rear axis parallel with the front axis, each rear wheel being at least essentially invariant in configuration during operation of the toy vehicle, each rear wheel having a weight, an outer circumference and a radius from the rear axis to the outer circumference, the improvement wherein at least two-thirds of the weight of each rear wheel is located within fifteen percent of an outer end of the rear wheel radius adjoining the outer circumference of the rear wheel.

In yet another aspect, the invention is an improvement in a remotely controlled toy vehicle including a pair of parallel front wheels and a pair of parallel rear wheels, centers of the front wheels lying along a common front axis and centers of the rear wheels lying along a common rear axis parallel with the front axis, a pair of reversible motors controlled remotely from the vehicle, each motor driving a separate one of the pair of rear wheels independently of the other motor and rear wheel to selectively propel and steer the toy vehicle during operation of the toy vehicle, an electric power supply on the vehicle coupled with the pair of reversible electric motors, the vehicle having a total weight including combined weights of the two rear wheels and the power supply, the improvement comprising the combined weights of the two rear wheels being more than thirty percent of the total weight of the vehicle including the combined weights of the two rear wheels and the electric power supply.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
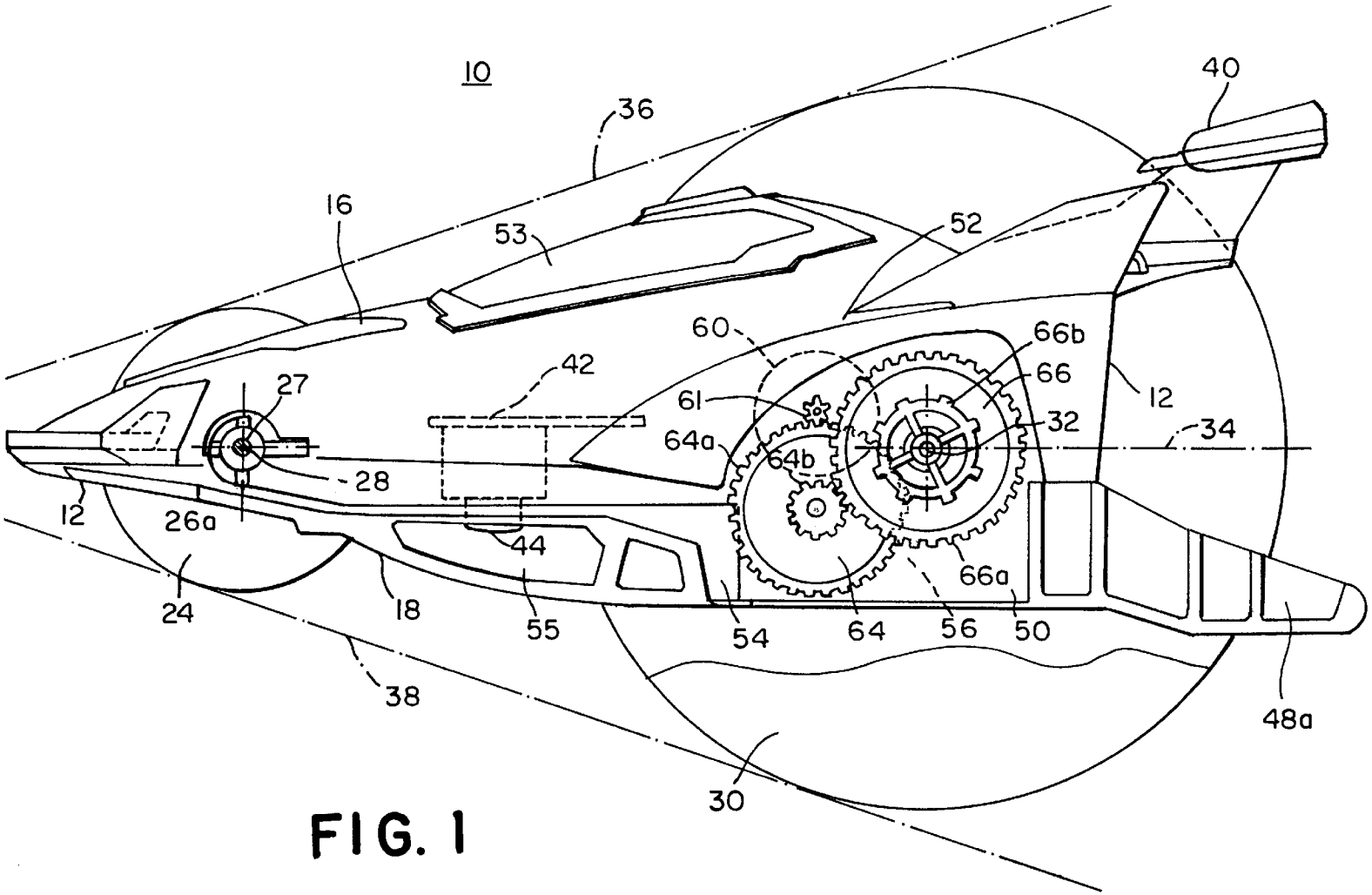
FIG. 1 is a partially broken away side elevation of a toy vehicle according to the present invention.

In the drawings, like numerals are used to indicate like elements throughout. Certain terminology is used in the following description for convenience only and is not limiting. The terms "right", "left", "lower", "upper", "top", "bottom", "horizontal" and "vertical" designate directions in the drawings to which reference is made. The terms "inwardly" and "outwardly" refer to directions toward and away from, respectively, the geometric center of the toy vehicle or designated parts thereof. These caveats apply to the words specifically mentioned above, and words of similar import.

Figure 2:
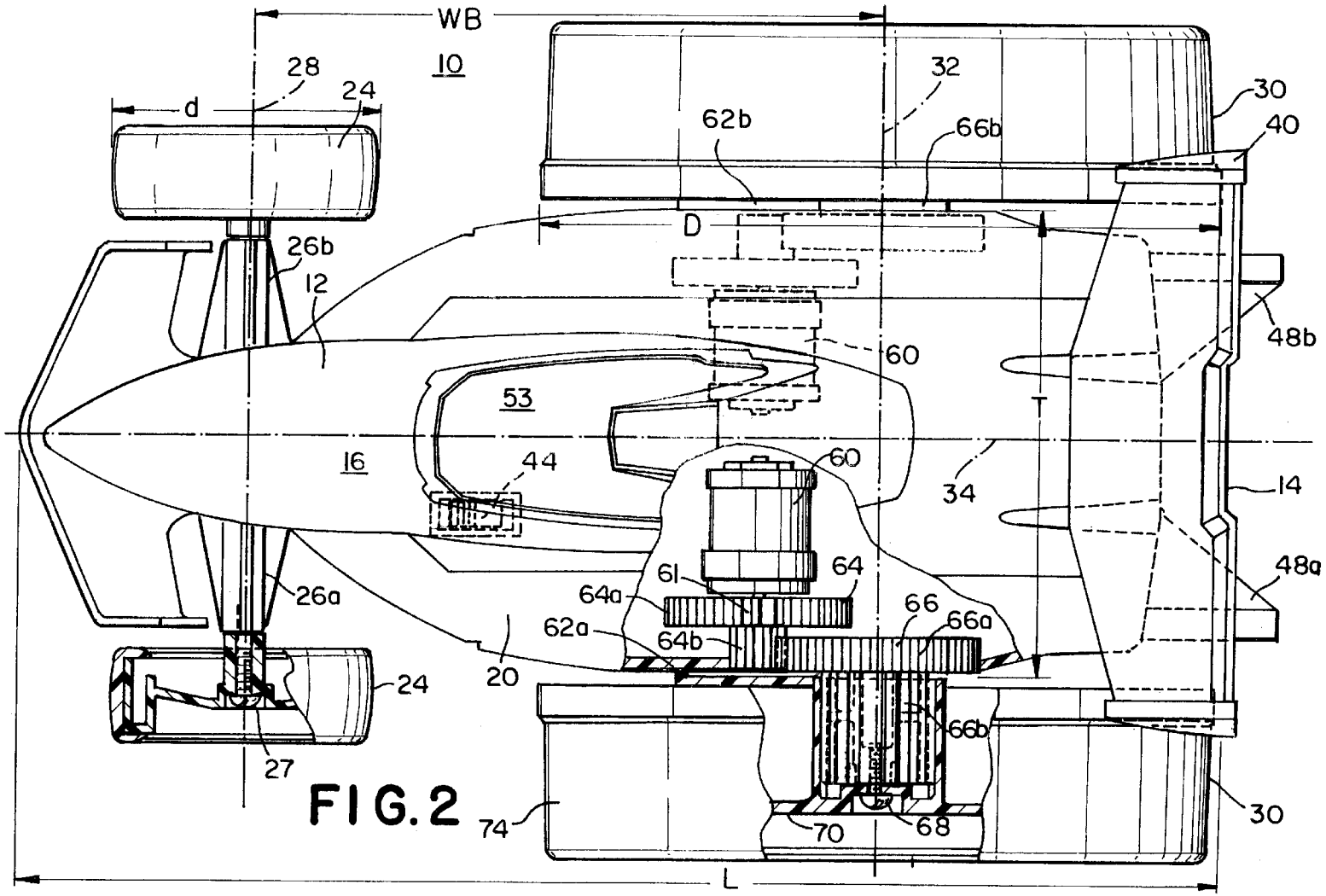
FIG. 2 is a partially broken away plan view of the upper side of the vehicle of FIG. 1.
Figure 3:
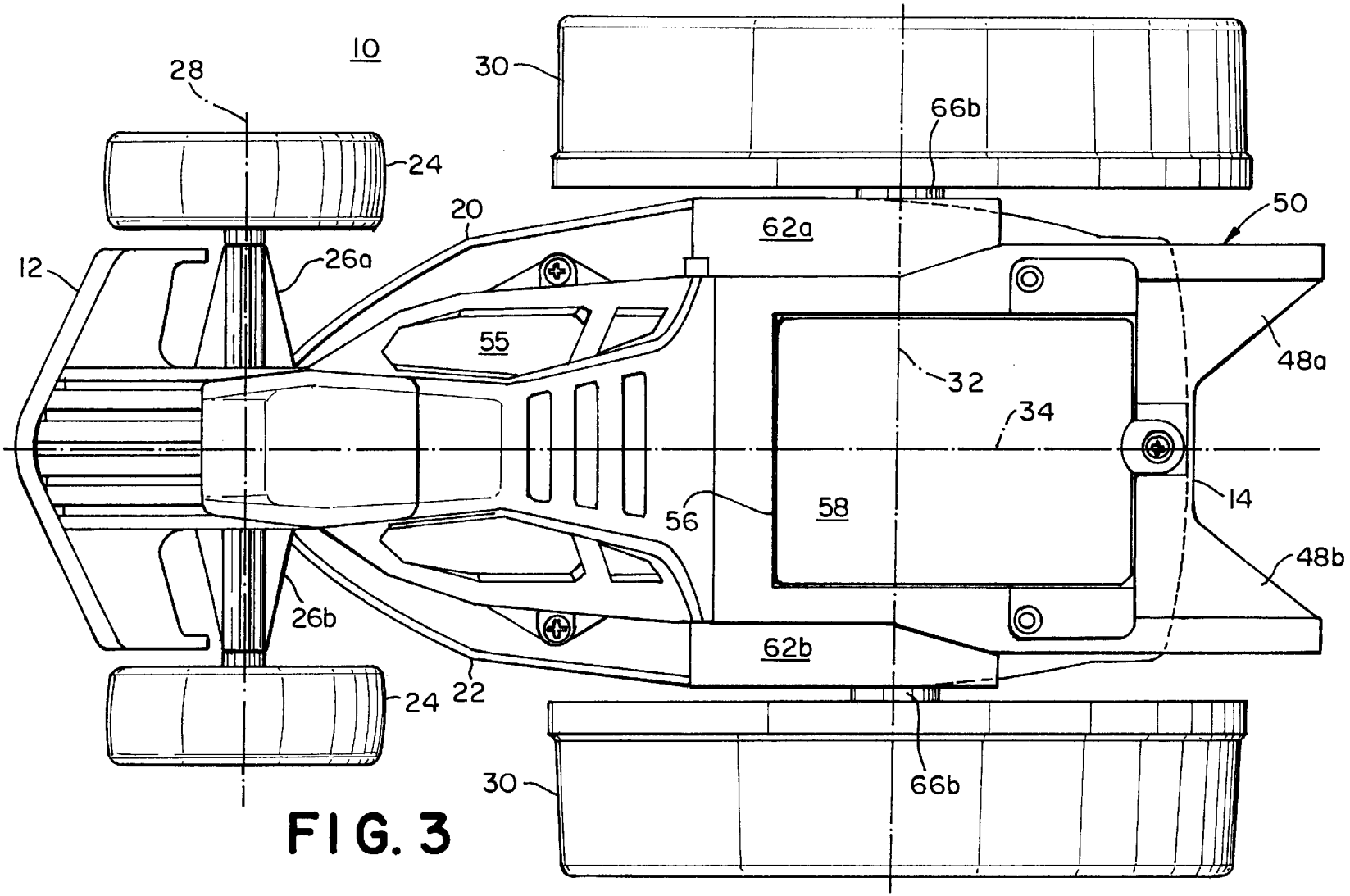
FIG. 3 is a partially broken away plan view of the bottom side of the vehicle of FIG. 1.

FIGS. 1–3 show, in varying views, a remotely controlled toy vehicle of the present invention, indicated generally at 10. More specifically, vehicle 10 is a wireless, radio-controlled toy vehicle. Vehicle 10 has a front 12, a rear 14, a first major side 16 seen in plan in FIG. 2, and a second, opposing major side 18 seen in plan in FIG. 3. Vehicle 10 has opposing first and second lateral sides 20, 22, respectfully.

Lateral side 20 is depicted in FIG. 1. Lateral side 22 is with very minor exceptions a mirror image. A pair of identical front wheels 24 are provided on either lateral side 20, 22 of the vehicle, supported for free rotation at the outer end of a pair of ribbed reinforced bosses 26*a*, 26*b*, by a shaft 27 (see FIG. 1) passing through the center of each wheel 20 into one of the bosses. Bosses 26*a*, 26*b* support the pair of front wheels 24 at their centers, parallel to one another, for rotation about a common front axis 28 extending perpendicularly between the wheels 24.

Vehicle 10 is equipped with a pair of identical rear wheels 30. Rear wheels 30 are powered by suitable means to be described. Centers of the rear wheels 30 lie along a common rear axis 32, which is parallel to the front axis 28. The wheels 24, 30 are parallel to one another and perpendicular to the front end rear axes 28, 32, respectively. Vehicle 10 has an imaginary, longitudinal center line 34 that extends through the centers of each of the common front and rear axes 28, 32 in parallel to the wheel 24, 30. A vertical plane through the center line, parallel to the plane of FIG. 1, bisects the vehicle 10 into two substantially mirror-image halves. Still referring to FIG. 1, axes 36, 38 are tangent to outside diameters (upper and lower sides in FIG. 1) of the front and rear wheels 24, 30. Axis 36 further represents an end view of a plane which is perpendicular to the plane of FIG. 1 and which is tangent to all four wheels 24, 30 and closest to the first major side 16. Likewise, axis 38 further represents an end view of a plane perpendicular to the plane of FIG. 1 which is tangent to all four wheels and closest to the second major side 18 of the vehicle.

A stylized wing 40 is provided at the rear 14 of the vehicle 10 projecting "upwardly" and "rearwardly" away from the remainder of the vehicle 10 and beyond the plan silhouette or outside diameter of the rear wheels 30. The rear of the second major side 18 of the vehicle 10 (lower side in FIG. 1) is also extended between the rear wheels 30 on either lateral side 20, 22 of the vehicle to define a pair of mirror image rear stands 48*a*, 48*b*. These too project rearwardly beyond the silhouette or outside diameters of the rear wheels 30. The wing 40 and stands 48*a*, 48*b* are used in the performance of various stunts of the toy vehicle 10.

Apart from the front and rear wheels 24, 30, and other components of the running gear to be described, the vehicle 10 is preferably formed by a main chassis 50 which supports the front and rear wheels 24, 30 as well as an "upper" body shell 52 including the stylized wing 40 and a stylized cockpit 53. A partial "lower" body shell 54 is secured to an opposing side of the main chassis 50 forming part of the opposing major side 18 of the vehicle at the front of the vehicle. The rear of the second major side 18 is devoted to a cavity 56 which is open on the second major side 18 (FIG. 3) and at the rear of the vehicle to receive a removable power supply 58, preferably in the form of an integral, rechargeable, battery pack. A suitably configured case with replaceable batteries may alternately be used although typically with some lesser degree of vehicle performance or operating time or both. Lower body shell 54 also includes a stylized cockpit 55. A printed board circuit 42 is protectively received in the front end of the chassis 50 between the body shells 52, 54. A power ON/OFF switch 44 is functionally and preferably physically coupled with the board 42 and positioned to project through the lower body shell 54 or chassis 50 on the second side 18 of the vehicle 10. The printed circuit board 42 is conventional and includes a radio receiver, logic circuitry, and power transistors for supplying power to each of a pair of identical motors 60 which are mounted in the rear of the chassis 50, each driving a separate one of the rear wheels 30 independently of the other motor and rear wheel to selectively propel and steer the toy vehicle 10 during operation of the vehicle 10. U.S. Pat. No. 5,135,247 is incorporated by reference herein and discloses circuitry for independent remote (radio) control of twin motored toy vehicles for steering and propulsion. The motors 60 are mounted in the chassis 50 between the cavity 56 receiving the power supply 58 and the "upper" body shell 52. A pair of mirror image transmission housings 62*a*, 62*b* are located between a central portion of the chassis and each of the rear wheels 30. Referring back to FIG. 1, the preferred components of the transmission are shown. The motor 60 includes a pinion 61 driving an integral, compound reduction gear 64 including a larger gear 64*a* engaged with the pinion 61 and a parallel smaller gear 64*b* driving a much larger wheel gear 66*a*. Wheel gear 66*a* is part of a drive member 66 which further includes a laterally outwardly protruding drive sprocket 66*b*. Compound reduction gear 64 and drive member 66 are journaled into the chassis 50 and the respective transmission housing 62*a* or 62*b* for rotation. The "lower" rear corner of vehicle 10 in FIG. 2 is partially broken away to indicate the coupling between the motor 60 and drive sprocket 66*b* and between that rear wheel 30 and the drive sprocket 66*b*.

Each rear wheel 30 is at least essentially invariant in size and configuration (form) during movement and all other possible operations of the toy vehicle 10. This is intended to distinguish toy vehicles like vehicle 10 from toy vehicles which can transform the size and/or configuration of their wheels or which transform themselves as a result of their own operation, like the rear wheels of the vehicle of U.S. Pat. No. 5,487,692. Wheels which are at least essentially invariant include those which are subject to normal deflections which "rigid" structures are subject to during operation and the ordinary flexing of inflated or merely hollow tires or wheels during use.

Figure 4:
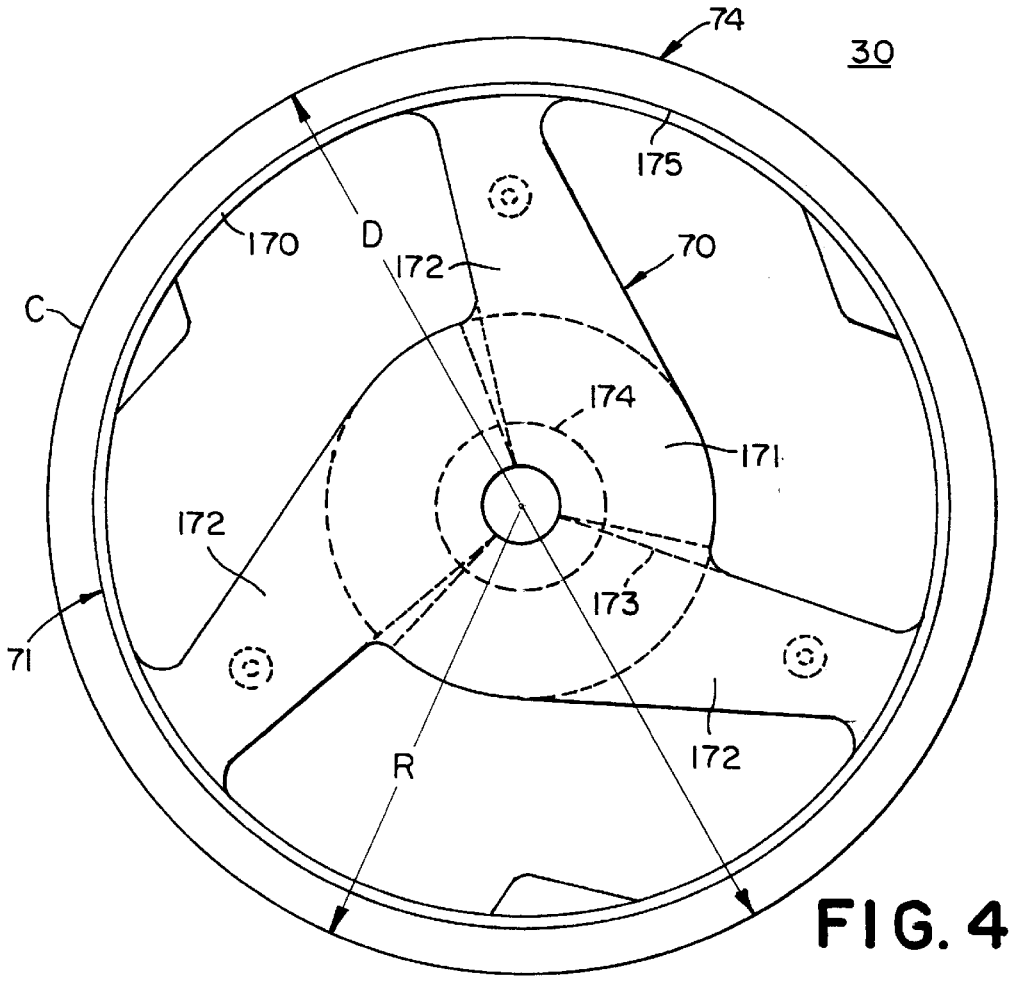
FIG. 4 is a side elevation of a rear wheel rim.
Figure 5:
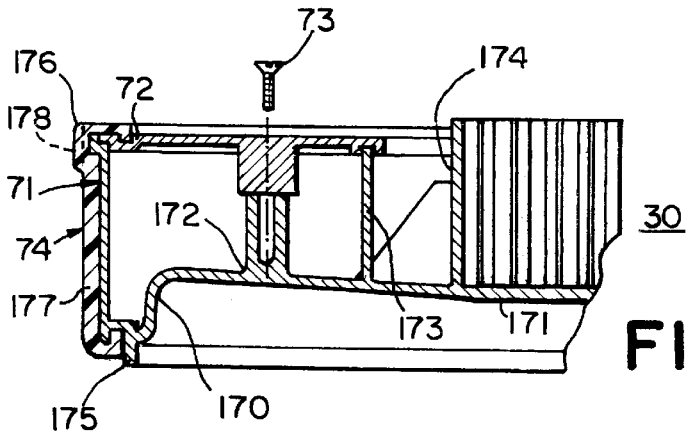
FIG. 5 is a partially broken away, exploded plan view of the rim of FIG. 4.

Each wheel 30 includes an identical rim assembly 70 and tire 74. Referring to FIGS. 4 and 5, the rim assembly 70 includes a main body 71 and, preferably, a backing plate 72 held to the main body by appropriate means such as threaded fasteners 73. The main body 71 includes a circumferential outer rim 170, a central hub 171 and three spokes 172 uniformly angularly and equidistantly spaced around the hub 171 connecting the hub with the rim 170. As can be seen from the figures, the main body 71 is of a hollow, lightweight construction. The hub 171 and spokes 172 are hollow and provided with reinforcing ribs 173. The backing plate is intended to prevent the hollow areas from filling with debris and to prevent users' fingers from being trapped and pinched if the wheels are grabbed during operation. The central hub is more particularly defined by splined collar 174, which projects outwardly from a "rear" side of the rim and receives the drive sprocket 66*b* projecting from the rear lateral side of the chassis. The splines of the collar 174 key with the radial projections on the sprocket 66*b*. The rim assembly 70 is secured to the sprocket 66*b* by suitable means such as, for example, a threaded fastener 68.

The low mass of the rim assembly 71 combined with the low, wide profile of the tire 74 and unusually large diameter of the rear wheel(s) 30 all contribute to the production of a gyroscopic moment when the rear wheel(s) 30 are rotated. Referring to FIG. 5, the tire 74 has an asymmetric profile. A raised area or ring 176 is provided along the innermost periphery of the wheel 30 closest to the chassis 50 and remainder of the vehicle 10. The raised area 176 constitutes only a fraction of the total width W of the tire and is at least less than half the width, desirably no more than a third of the width, and preferably only about one-fourth or less of the width W of the tire 74. The remainder of the tire 74 is essentially flat, extends around the circumference of the rim 170. Tire 74 further overlaps an outer lateral side (the "front") of the rim and overlaps the opposing lateral side (the "rear" side) of the tire, overlapping the backing plate 72. The main body 71 of the rim assembly 70 includes a circular flange 175 on the circular rim 170 which projects axially outwardly from the main body 71 beyond the edge of the tire 74 and is provided for stunt purposes as will be subsequently described. The wheels 30 are relatively wide and flat to further increase the percentage of the mass of the wheels at their outer circumferences. Further, the rear wheel tires 74 are of a material, such as vinyl or high durometer rubber, which enables the tires to slip to some extent, even in solid contact with the supporting surface, to permit the wheel to achieve high RPM quickly and well before the vehicle achieves top operating speed or even a significant percentage of top operating speed, if the wheels are accelerated hard.

While the tire 74 may be of a one-piece, single material composition, the raised area 176 may be provided by a separate material band indicated in phantom at 177 which overlies the remainder of the tire indicated in phantom at 178. In this configuration, the separate material band 177 is of a relatively higher gripping material having a higher coefficient of friction than does the vinyl material of the remainder of the tire 74. This provides better gripping by the tire 74 when the vehicle is running straight and upright. It also enables the vehicle to use the lower torque in turning and to turn or spin more quickly than it otherwise would have in an ordinary upright position with a fully vinyl tire. The vinyl or other material of the tire 74 would have a lower coefficient of friction to allow that portion of the tire 74 to slip on carpets and to allow the wheel 30 to spin to near no-load speeds even when the vehicle 10 is being supported on that portion of the tire, which is itself in contact with the vehicle supporting surface. The circular flange 175 projecting axially from the outer side of the wheel 30 has the lowest coefficient friction and forms a "rub ring" which allows maximum slippage when the vehicle 10 is on its side being supported on the wheel 30. This allows maximum slip for side spin stunts. The rear wheels 30 have little to low grip in the area of the wheel where they are supported by both the remainder 178 of the tire and of the circumferential flange or rub ring 175.

The design of the rear wheels 30 makes them efficient flywheels which create relatively greater is gyroscopic force than have otherwise been achieved before in powered vehicles for new and unique stunts and action. This gyroscopic effect is, in large part, a result of the geometry and physical characteristics of the rear wheels 30 themselves as well as their relation to one another and the overall vehicle 10. The rear wheels 30 are relatively large and have a maximum outer diameter D, which is the diameter around the raised portion 176 of the tire 74, of 5.875 inches and a diameter around the remainder of the tire 178 of 5.75 inches. The rear wheels are spaced relatively close together with the outer diameter of the rear wheels being greater than a minimum (i.e, perpendicular) distance T between facing (inner) sides of the pair of rear wheels 30. The rear wheels 30 are less than four inches hub-to-hub and less than 4.2 inches rim-to-rim in vehicle 10.

The rear wheels 30 provide a significant portion of the weight of the vehicle 10. For example, the vehicle 10, equipped with a removable battery pack 58 for operation, weighs about 660 grams without the pack and about 810 grams with the pack. The rear wheels 30 weigh 126 grams each. Thus, the combined weight (252 grams) of the powered, rear wheels 30 is approximately 38 percent of the operating weight of the vehicle 10 without the pack and still at least thirty percent or more of the total weight of the vehicle (including the weight of the rear wheels and the battery pack). This compares to less than thirty percent with and less than twenty-five percent without the battery pack in other, prior stunt RC vehicles. Also, more than 100 of the 126 grams of the total weight of each rear wheel 30 is located within fifteen percent of the outer diameter of the wheel 20 (i.e., located in fifteen percent of an outer end of a rear wheel radius R extending from the center of the wheel to the outermost circumference C of the rear wheel).

The moment of inertia of the wheels 30 about their center is approximately 0.780 gram–$m^2$. This compares with less than 0.25 gram–$m^2$ for other prior stunt RC toy vehicles, with four inch diameter drive wheels. Because of the limited gripping provided by the design of the rear tire 74, the torque requirements of the vehicle 10 are not as high as other, prior stunt vehicles. Accordingly, the output of the motors 60 need not be reduced as much as in other vehicles. The gear reduction provided by the transmission is only about 25 to 1 (25.89:1). As a result, the maximum, no-load wheel speed of the rear wheels 30 is approximately 1,400 RPM. This compares with only about 1200 RPM or less maximum rotational speed for the other prior stunt RC toy vehicles. The relatively high rotational speed at which the powered wheels can turn as well as their relatively high moment of inertia all combine to produce gyroscopic forces which affect the vehicle 10 and affect the types of stunts which can be performed with the vehicle 10.

The relationship of rear wheels 30 to the overall vehicle 10 is also important. Vehicle 10 may have an overall length L of 11 inches along a longitudinal center line 34 between planes perpendicular to the center line 34 and tangent to the bumper 29 at the extreme front 12 of the vehicle and tangent to the stands 48*a*, 48*b* at the extreme rear of the vehicle. The wheel base WB (perpendicular distance) between the front and rear axes 28, 32 is about 5.5 inches measured along the center line 34. In contrast, the front wheels 24 have a diameter d of only 2.3 inches.

To provide the desired gyroscopic effect, it is recommended that the rear wheels have a diameter D at least equal to, and preferably greater than, the wheel base distance between the front and rear axes. It is further suggested that the outer diameter of the rear, driven wheels further be at least equal to and preferably greater than one-half the vehicle length L between the front and rear of the vehicle along the longitudinal center line.

Further contributing to the unique stunt ability of this vehicle is the location of the next major weight component, the removable battery pack, positioned in the vehicle 10 longitudinally overlapping and extending rearwardly from the rear wheel axis 32. In the operating configuration with removable battery pack installed, the center of gravity of the vehicle 10 is located approximately one-half inch in front of the rear wheel axis 32.

As an example of its unique ability, the vehicle 10 can be turned to the left or right riding on only the two wheels along one lateral side 20, 22 of the vehicle are in contact with the support surface.

In forward acceleration, the rear chassis extensions or stands 48*a*, 48*b* will contact the surface supporting the vehicle 10 and limit the height to which the front 12 of the vehicle 10 will rise. When the vehicle 10 is operated with its first major side 16 down facing the support surface, the tips of wing 40 perform the same function.

Both the chassis extensions 48*a*, 48*b* and the extreme rear tips of the wing 40 extend beyond the envelope defined around the remainder of the vehicle by the front and rear wheels 24, 40. Normally, this might prevent the vehicle 10 from being able to flip itself over so that either major side 16, 18 may face up and away from the surface supporting the vehicle 10. However, it is possible to flip vehicle 10 over by first running the vehicle at maximum speed in a rearward direction and then suddenly reversing the direction of both motors to the forward direction. The rearward momentum causes the remainder of the vehicle 10 to pivot over the common rear axis 32 about the rear wheel with enough momentum to carry the vehicle 10 over the extreme ends of the stands 48*a*, 48*b* or tips of the wing 40. If done at a sufficiently high rearward speed, the vehicle 10 is launched into the air to perform at least a 180° flip and may actually rotate more than 180° over onto its front bumper 29 or completely flip over onto its original side. Multiple sequential flips are common. If both of the powered rear wheels are driven in the same direction at approximately the same speed, the vehicle will continue to flip in a straight line with its wheel axes 28, 32 generally parallel to one another and the support surface. However, if only one wheel 30 is powered or if they are powered at sufficiently different speeds or if they are powered in reverse directions, the resulting gyroscopic imbalance will cause the vehicle 10 to also twist laterally while it is flipping.

Another stunt which can be performed by the vehicle 10 is to stand the vehicle on end supported by the chassis extensions 48*a*, 48*b* and the tips of the wing 40 with all four wheels 24, 30 elevated off the ground. This can be done with practice by selecting the speed of the vehicle 10 running in a reverse direction when the direction of the motor rotations are reversed. The vehicle 10 can be made to topple from its upright position down onto all four of its wheels by running the raised, powered rear wheels 30 in a first direction and then suddenly reversing the directions of the wheels.

Another stunt which can be performed is to run the motors simultaneously in opposite directions at the same speed. This will cause the vehicle to spin in place. As the spin increases in speed, the front wheels will eventually rise off the support surface so that the vehicle is supported only on the rear two wheels and spin about an axis extending perpendicularly from the plane of the support surface on which the vehicle is spinning through the longitudinal center line 34 and common rear axis 32. If the direction of rotation of one of the motors is reversed, the vehicle will tend to pitch over onto the wheel 30 connected with the motor 60 continuing to drive in the original direction so that the vehicle continues to spin on only one of the four wheels. Also, if the vehicle 10 lands on one of its lateral sides, it can be made to right itself by rotating both wheels in opposite directions. The ground contacting rear wheel, even supported on the harder, more slippery axially projecting circular flange 175, will not spin as rapidly as the upper rear wheel facing away from the support surface. The unbalanced gyroscopic effect will tend to cause the vehicle 10 to rock about and eventually throw itself back onto all four wheels.

Two wheel turning is achieved by differential steering. That is, the motors are run to rotate the wheels to propel the vehicle in the same direction (forward or rearward) but at different speeds. The vehicle starts to tip beginning its turn due to centrifugal force, and the rear wheel rises off the support surface and begins spinning at a higher rate of speed creating a counterbalancing gyroscopic force balancing the vehicle on the two lateral wheels on the outside of the turn. Differential steering control of two motors is known and is disclosed, for example, in the U.S. Pat. No. 5,135,427, incorporated by reference herein.

It will be appreciated by those skilled in the art that changes could be made to the embodiments described above without departing from the broad inventive concept thereof. For example, while the friction coefficient or grip of different areas of the tire may be varied by using different materials, they may be varied in other ways, for example, by varying the texture of different parts of the exposed surface of the tire. It is understood, therefore, that this invention is not limited to the particular embodiments disclosed, but it is intended to cover modifications within the spirit and scope of the present invention as defined by the appended claims.

We claim:

1. In a remotely controlled toy vehicle including a pair of parallel front wheels, a pair of rear wheels at least essentially invariant in configuration and outer diameter during operation, a pair of reversible motors controlled remotely from the vehicle, each motor driving a separate one of the pair of rear wheels independently of the other motor to selectively propel and steer the vehicle during operation of the vehicle, centers of the front wheels lying along a common front axis and centers of the rear wheels lying along a common rear axis parallel with the front axis, the improvement wherein each rear wheel has a fixed maximum outer diameter greater than a minimum distance between facing sides of the pair of rear wheels.

2. In the toy vehicle of claim 1, the improvement further comprising the rear wheel diameters being more than twice diameters of each front wheel.

3. In the toy vehicle of claim 1 further having a front, a rear, a longitudinal centerline and a vehicle length between the front and the rear along the longitudinal centerline, the improvement further comprising the rear wheel diameters being greater than one-half the vehicle length.

4. In the toy vehicle of claim 1 wherein each rear wheel has a weight, an outer circumference and a radius from the rear axis to the outer circumference, the improvement further comprising at least two-thirds of the weight of each rear wheel being located within fifteen percent of an outer end of the rear wheel radius adjoining the outer circumference of the rear wheel.

5. In the toy vehicle of claim 1 wherein each rear wheel has a weight, an outer circumference and a radius from the rear axis to the outer circumference, the improvement further comprising at least three-quarters of the weight of each rear wheel being located within fifteen percent of an outer end of the rear wheel radius adjoining the outer circumference of the rear wheel.

6. In the toy vehicle of claim 1 wherein each rear wheel has a weight and the vehicle has a total weight for operation excluding any power supply and including the combined weights of the two rear wheels, the improvement further comprising the combined weights of the two rear wheels being at least thirty percent of the total weight of the vehicle for operation.

7. In the toy vehicle of claim 1 wherein the fixed maximum outer diameter of each rear wheel is further greater than a minimum distance between the front and rear axes.

8. In a remotely controlled toy vehicle including a pair of parallel front wheels and a pair of rear wheels, a pair of reversible motors controlled remotely from the vehicle, each motor driving a separate one of the pair of rear wheels independently of the other motor and rear wheel to selectively propel and steer the toy vehicle during operation of the vehicle, centers of the front wheels lying along a common front axis and centers of the rear wheels lying along a common rear axis parallel with the front axis, each rear wheel being at least essentially invariant in configuration during operation of the toy vehicle, each rear wheel having a weight, an outer circumference and a radius from the rear axis to the outer circumference, the improvement wherein at least two-thirds of the weight of each rear wheel is located within fifteen percent of an outer end of the rear wheel radius adjoining the outer circumference of the rear wheel.

9. In the toy vehicle of claim 8, the improvement further comprising at least three-quarters of the weight of each rear wheel being located within fifteen percent of the outer end of the rear wheel radius adjoining the outer circumference of the rear wheel.

10. In the toy vehicle of claim 8 wherein the improvement further comprising each rear wheel having a diameter greater than a distance between the parallel front and rear axes.

11. In a remotely controlled toy vehicle including a pair of parallel front wheels and a pair of parallel rear wheels, centers of the front wheels lying along a common front axis and centers of the rear wheels lying along a common rear axis parallel with the front axis, a pair of reversible motors controlled remotely from the vehicle, each motor driving a separate one of the pair of rear wheels independently of the other motor and rear wheel to selectively propel and steer the toy vehicle during operation of the toy vehicle, an electric power supply on the vehicle coupled with the pair of reversible electric motors, the vehicle having a total weight including combined weights of the two rear wheels and the power supply, the improvement comprising the combined weights of the two rear wheels being more than thirty percent of the total weight of the vehicle including the combined weights of the two rear wheels and the electric power supply.

* * * * *